United States Patent [19]

Hughes

[11] 4,406,970

[45] Sep. 27, 1983

[54] COLOR PICTURE TUBE HAVING AN EXPANDED FOCUS LENS TYPE INLINE ELECTRON GUN WITH AN IMPROVED STIGMATOR

[75] Inventor: Richard H. Hughes, Lancaster, Pa.

[73] Assignee: RCA Corporation, New York, N.Y.

[21] Appl. No.: 282,229

[22] Filed: Jul. 10, 1981

[51] Int. Cl.[3] ..... H01J 29/50; H01J 29/62

[52] U.S. Cl. ..... 313/414; 313/460

[58] Field of Search ..... 313/414, 449, 460, 458, 313/412, 409

[56] References Cited

U.S. PATENT DOCUMENTS 4,317,065 2/1982 Hughes ..... 313/414

4,370,592 1/1983 Hughes et al. ..... 313/414

*Primary Examiner*—Palmer C. Demeo

*Attorney, Agent, or Firm*—Eugene M. Whitacre; Dennis H. Irlbeck

[57] ABSTRACT

An improved color picture tube has an inline electron gun for generating and directing three electron beams, a center beam and two side beams, along coplanar paths toward a screen of the tube. The gun includes a main focus lens for focusing the electron beams. The main focus lens is formed by two spaced electrode members each having three separate inline apertures therein. Each electrode also includes a peripheral rim. The peripheral rims of the two electrodes face each other. The apertured portion of each electrode is within a recess set back from the rim. The main focus lens electrode closest to the screen includes a slot on the side facing the screen. The slot extends in the direction of the three electron beam paths. The slot is wider, in a direction perpendicular to the plane of the three electron beam paths, at the side beam paths than at the center beam pa

2 Claims, 5 Drawing Figures

Fig. 1
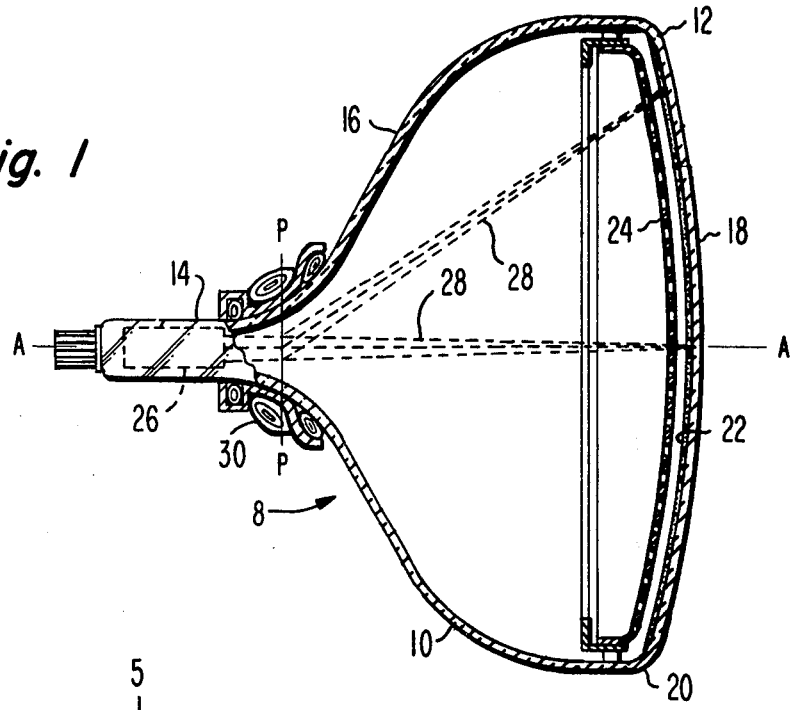
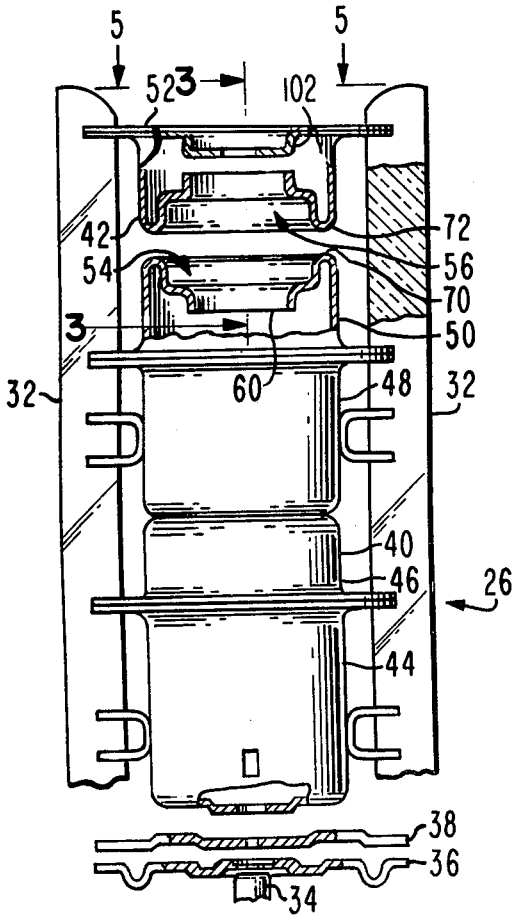
Fig. 2

COLOR PICTURE TUBE HAVING AN EXPANDED FOCUS LENS TYPE INLINE ELECTRON GUN WITH AN IMPROVED STIGMATOR

BACKGROUND OF THE INVENTION

The present invention relates to color picture tubes having improved inline electron guns, and particularly to an improvement in such guns of an expanded focus lens type for correcting astigmatism formed by the expanded focus lens.

An inline electron gun is one designed to generate or initiate preferably three electron beams in a common plane and direct those beams along convergent paths in that plane to a point or small area of convergence near the tube screen. In one type of inline electron gun shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes. These electrodes include two cup-shaped members having bottoms facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced from each other, thereby providing a severe limitation on focus lens design. It is known in the art that the larger the focus lens diameter, the less will be the spherical aberration which restricts the focus quality.

In addition to the focus lens diameter, the spacing between focus lens electrode surfaces is important, because greater spacing provides a more gentle voltage gradient in the lens which also reduces spherical aberration. Unfortunately, greater spacing between electrodes beyond a particular limit (typically 1.27 mm) generally is not permissible because of beam bending from electrostatic charges on the neck glass penetrating into the space between the electrodes, which causes electron beam misconvergence.

In copending U.S. Pat. Application Ser. No. 201,692, filed Oct. 29, 1980 by R. H. Hughes and B. G. Marks, now Pat. No. 4,370,592, an electron gun is described wherein the main focus lens is formed by two spaced electrodes. Each electrode includes a plurality of apertures therein equal to the number of electron beams and also a peripheral rim, with the peripheral rims of the two electrodes facing each other. The apertured portion of each electrode is located within a recess set back from the rim. The effect of this main focus lens is to provide the gentle voltage gradient sought to reduce spherical aberration. However, the main focus lens causes a slot effect astigmatism that is corrected in the electron gun by the addition of a horizontal slot opening at the exit of the second focus and accelerating electrode. This slot is formed by two parallel strips, which provide a similar effect on all three electron beams. The present invention provides different effects on the electron beams, primarily to further improve the focus quality of the side electron beams.

SUMMARY OF THE INVENTION

An improved color picture tube has an inline electron gun for generating and directing three electron beams, a center beam and two side beams, along coplanar paths toward a screen of the tube. The gun includes a main focus lens for focusing the electron beams. The main focus lens is formed by two spaced electrode members each having three separate inline apertures therein. Each electrode also includes a peripheral rim. The peripheral rims of the two electrodes face each other. The apertured portion of each electrode is within a recess set back from the rim. The main focus lens electrode closest to the screen includes a slot on the side facing the screen. The slot extends in the direction of the three electron beam paths. The slot is wider, in a direction perpendicular to the plane of the three electron beam paths, at the side beam paths than at the center beam path.

BRIEF DESCRIPTION OF THE DRAWINGS

FIG. 1 is a plan view, partly in axial section, of a shadow mask color picture tube embodying the invention.

FIG. 2 is a partial axial section view of the electron gun shown in dashed lines in FIG. 1.

DETAILED DESCRIPTION OF THE PREFERRED EMBODIMENT

Figure 3:
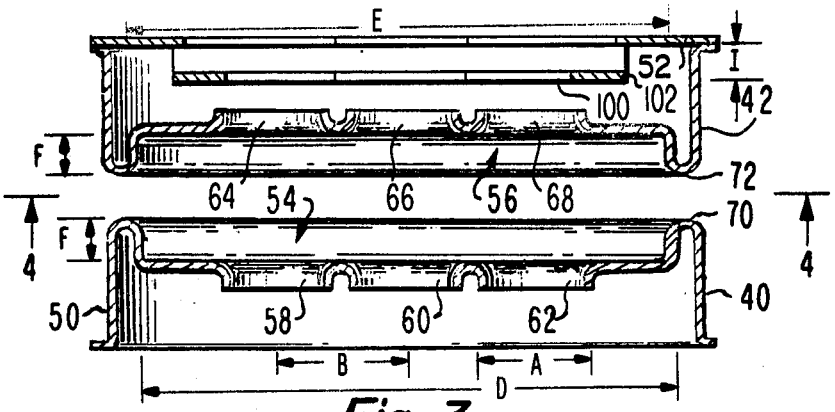
FIG. 3 is an axial sectional view of the G3 and G4 electrodes of the electron gun of FIG. 2.

FIG. 1 is a plan view of a rectangular color picture tube 8 having a glass envelope 10 comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (i.e., normal to the plane of FIG. 1). A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 schematically shown surrounding the neck 14 and funnel 16 in the neighborhood of their junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

The details of the gun 26 are shown in FIGS. 2 through 5. The gun comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 also is cup-shaped, but has its open end closed with an apertured plate 52.

The facing closed ends of the G3 electrode 40 and the G4 electrode 42 have large recesses 54 and 56, respectively, therein. The recesses 54 and 56 set back the portion of the closed end of the G3 electrode 40 that contains three apertures, 58, 60 and 62, from the portion of the closed end of the G4 electrode 42 that contains three apertures, 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closest portions of the two electrodes 40 and 42.

The electron gun 26 of FIG. 2 provides a main focusing lens having substantially reduced spherical aberration compared to that of prior guns discussed above. The reduction in spherical aberration is caused by an increase in the size of the main focus lens. This increase in lens size results from recessing the electrode apertures. In most prior inline guns, the strongest equipotential lines of the electrostatic field are concentrated at each opposing pair of apertures. However, in the gun 26 of FIG. 2, the strongest equipotential lines extend continuously from between the rims 70 and 72, so that the predominant portion of the main focus lens appears to be a single large lens extending through the three electron beam paths. The remaining portion of the main focus lens is formed by weaker equipotential lines located at the apertures in the electrodes. The performance and advantages of an electron gun similar to the electron gun 26 are discussed in previously-cited copending U.S. Pat. Application Ser. No. 201,692.

Figure 4:
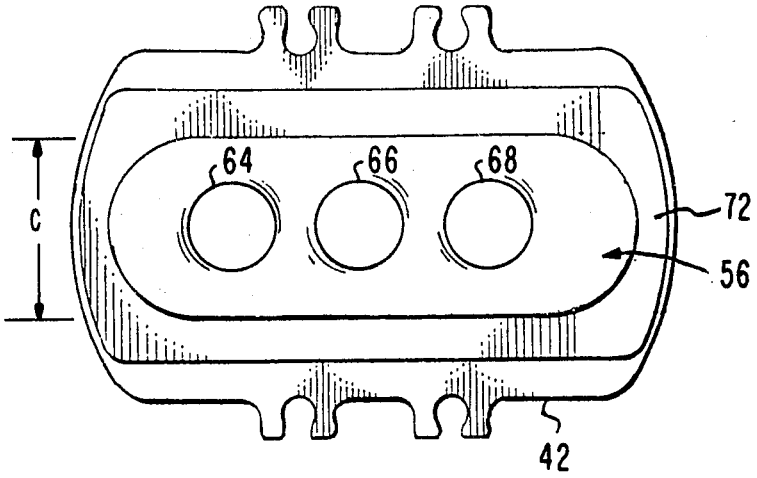
FIG. 4 is a front view of the electron gun of FIG. 2 taken along line 4—4 of FIG. 3.
Figure 5:
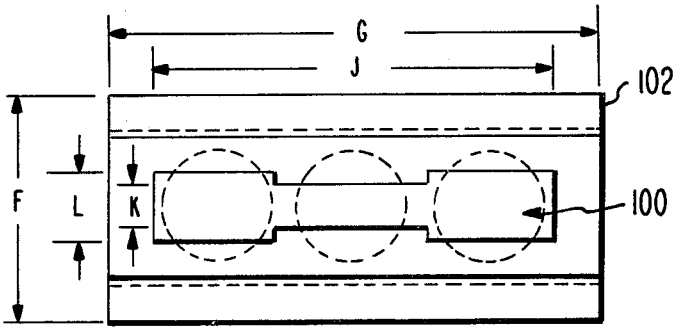
FIG. 5 is a plan view of a novel stigmator embodiment.

Preferably, as shown in FIGS. 3 and 4, the depths "F" of the recesses 54 and 56 are roughly one-quarter the spacings "C" between the two straight sides of the recesses. The diameter of each aperture in the G3 electrode 40 is such as to just touch an equipotential line within four percent of the electrode voltage that would exist if the apertured portion of the electrode were not present. In the embodiment shown, this four percent line is approximately a semicircle. Spacing of the two electrodes 40 and 42 should be close enough to exclude neck charging from bending electron beams.

There is an astigmatism, i.e., asymmetric effect, formed by the main focusing lens as a result of penetration of the focusing field through the open areas of the recesses. This effect is caused by the greater compression of equipotential lines at the sides of the focus lens than at the two areas near the center of the focus lens. The field penetration causes the focus lens to have greater vertical lens strength than horizontal lens strength. A correction is made for this astigmatism in the electron gun 26 of FIG. 2 by the inclusion of a horizontal slot opening 100 at the exit of the G4 electrode 42 which acts like an electron beam stigmator. The slot 100 is located in a bracket 102 which is attached to the plate 52, in turn attached to the screen side of the G4 electrode 42.

To minimize any center-to-side gun focus voltage differential and improve the focus quality of the side beams, the slot 100 is dogboned in shape, being wider, measured in a direction perpendicular to the inline direction of the three electron beam paths, at the side beam paths than it is at the center beam path. This slot shape provides a weaker stigmator effect on the two side beams than on the center beam.

To statically converge the two outer beams with the center beam, the wide "E" of the recess 56 in the G4 electrode 42 is slightly greater than the width "D" of the recess 54 in the G3 electrode 40 (FIG. 3). The effect of the greater recess width in the G4 electrode 42 is the same as that discussed with respect to the offset apertures in U.S. Pat. No. 3,772,554, issued to R. H. Hughes on Nov. 13, 1973.

Some typical dimensions for the electron gun 26 of FIG. 2 are presented in the following table.

TABLE

| | |
|---|---|
| External diameter of tube neck | 29.00 mm |
| Internal diameter of tube neck | 24.00 mm |
| Spacing between G3 and G4 electrodes 40 and 42 | 1.27 mm |
| Center-to-center spacing between adjacent aperatures in G3 electrode 40 (A in FIG. 3) | 5.0 mm |
| Inner diameter of apertures 58, 60 and 62 in G3 electrode 40 (B in FIG. 3) | 4.0 mm |
| Spacing between two straight sides of recesses in the electrodes 40 and 42 (C in FIG. 4) | 8.0 mm |
| Width of recess in the G3 electrode 40 (D in FIG. 3) | 18.2 mm |
| Width of recess in the G4 electrode 42 (E in FIG. 3) | 18.6 mm |
| Depth of recesses in the electrodes 40 and 42 (F in FIG. 3) | 2.03 mm |
| Length of stigmator bracket (G in FIG. 5) | 15.37 mm |
| Width of stigmator bracket (H in FIG. 5) | 7.88 mm |
| Height of stigmator bracket (I in FIG. 3) | 3.10 mm |
| Length of slot (J in FIG. 5) | 13.46 mm |
| Minimum width of slot (K in FIG. 5) | 1.52 mm |
| Maximum width of slog (L in FIG. 5) | 2.29 mm |

In various other inline electron gun embodiments, the depth of the recess in the electrode 40 and 42 may vary from 1.30 mm to 2.80 mm and the depths of the recesses in the two electrodes 40 and 42 may be varied from each other.

What is claimed is:

1. In a color picture tube having an inline electron gun for generating and directing three electron beams, a center beam and two side beams, along coplanar paths toward a screen of said tube, said gun including a main focus lens for focusing said electron beams, the main focus lens being formed by two spaced electrode members each having three separate inline apertures therein, each electrode also including a peripheral rim, the peripheral rims of the two electrodes facing each other, and the apertured portion of each electrode being within a recess set back from the rim, the improvement comprising the main focus lens electrode closest to said screen including a slot on the side facing the screen, said slot extending in the inline direction of the three electron beam paths, and said slot being wider, in a direction perpendicular to the plane of the three electron beam paths, at the side beam paths than at the center beam path.

2. The tube as defined in claim 1, wherein said main focus lens electrode closest to said screen includes a bracket attached thereto on the screen side thereof, said bracket including said slot.

* * * * *